US012410530B1

(12) United States Patent
Ahamad et al.

(10) Patent No.: US 12,410,530 B1
(45) Date of Patent: Sep. 9, 2025

(54) METHOD OF MAKING A METAL-N/S-DOPED CARBON ELECTROCATALYST

(71) Applicant: KING SAUD UNIVERSITY, Riyadh (SA)

(72) Inventors: Tansir Ahamad, Riyadh (SA); Rahaf Mansour Alotaibi, Riyadh (SA); Faten Abdullah Alsamhan, Riyadh (SA); Saad Mohammed Alshehri, Riyadh (SA); Jahangeer Ahmed, Riyadh (SA); Osamah Mohammad Alduhaish, Riyadh (SA)

(73) Assignee: KING SAUD UNIVERSITY, Riyadh (SA)

( * ) Notice: Subject to any disclaimer, the term of this patent is extended or adjusted under 35 U.S.C. 154(b) by 0 days.

(21) Appl. No.: 19/238,240

(22) Filed: Jun. 13, 2025

(51) Int. Cl.
*C25B 11/091* (2021.01)
*C25B 11/052* (2021.01)
*C25B 11/065* (2021.01)

(52) U.S. Cl.
CPC ..... *C25B 11/091* (2021.01); *C25B 11/052* (2021.01); *C25B 11/065* (2021.01)

(58) Field of Classification Search
CPC ... B01J 21/18; B01J 35/33; B01J 37/08; B01J 37/343; C25B 11/091; C25B 11/052; C25B 11/065
USPC ..... 502/5, 101, 182, 185; 423/445 R, 460
See application file for complete search history.

(56) References Cited

FOREIGN PATENT DOCUMENTS

| | | | | | |
|---|---|---|---|---|---|
| CN | 112481640 | A | | 3/2021 | |
| CN | 112591747 | A | * | 4/2021 | ..... C01B 32/324 |
| CN | 113073337 | A | | 7/2021 | |
| CN | 113215594 | A | | 8/2021 | |
| DE | 202024101249 | U1 | * | 4/2024 | ..... B09B 3/40 |
| JP | 2004300198 | A | * | 10/2004 | ..... B09B 3/00 |

OTHER PUBLICATIONS

Jeremiah Lekwuwa Chukwuneke et al., "Optimization of cyanide adsorption from cassava wastewater using phosphoric acid-functionalized activated carbons derived from livestock keratin waste via in-situ and ex-situ activation routes." Desalination and Water Treatment 320, pp. 1-15. (Year: 2024).*

(Continued)

*Primary Examiner* — Patricia L. Hailey
(74) *Attorney, Agent, or Firm* — Nath, Goldberg & Meyer; Joshua B. Goldberg

(57) ABSTRACT

The method of making a metal-N/S-doped carbon electrocatalyst is a method of making an electrocatalyst for an electrolyzing electrode or the like. The carbon for the electrocatalyst comes from goat hooves as a sustainable and environmentally friendly source of carbon. At least one goat hoof is cleaned and then sonicated. The cleaned and sonicated goat hoof is then calcined at a temperature of approximately 300° C. to produce a carbonaceous precursor. The carbonaceous precursor is treated with a HCl solution, followed by drying. At least one metal salt is added to the treated carbonaceous precursor, and the at least one metal salt and the treated carbonaceous precursor are heated to form the metal-N/S-doped carbon electrocatalyst.

13 Claims, 10 Drawing Sheets
(6 of 10 Drawing Sheet(s) Filed in Color)

(56) References Cited

OTHER PUBLICATIONS

Diego Ramón Lobato-Peralta et al., "Optimizing pre-carbonization temperature in sustainable cow hoof-derived activated carbon for high-performance supercapacitor electrodes." Surfaces and Interfaces 56, pp. 1-9. (Year: 2025).*

Hai Liu et al., "Evaluation of animal hairs-based activated carbon for sorption of norfloxacin and acetaminophen by comparing with cattail fiber-based activated carbon." Journal of Analytical and Applied Pyrolysis 101, pp. 156-165 (Year: 2013).*

He, Fangzhen, et al. "Construction of nickel nanoparticles embedded in nitrogen self-doped graphene-like carbon derived from waste grapefruit peel for multifunctional OER, HER, and magnetism investigations." Journal of Environmental Chemical Engineering 9.6 (2021): 106894. (Abstract only).

Zou, Yajun, et al. "3D hierarchical heterostructure assembled by NiFe LDH/(NiFe) Sx on biomass-derived hollow carbon microtubes as bifunctional electrocatalysts for overall water splitting." Electrochimica Acta 348 (2020): 136339.

Gai, Chao, et al. "Hydrochar supported bimetallic Ni—Fe nanocatalysts with tailored composition, size and shape for improved biomass steam reforming performance." Green Chemistry 20.12 (2018): 2788-2800.

* cited by examiner

METHOD OF MAKING A METAL-N/S-DOPED CARBON ELECTROCATALYST

BACKGROUND

Field

The disclosure of the present patent application relates to electrocatalysts for the preparation of electrodes, such as those used in the electrolysis of water and the like, and particularly to a method of making an electrocatalyst of nickel-N/S-doped and nickel-iron-N/S-doped graphite carbon.

Description of Related Art

Due to environmental concerns, there is presently great interest in the use of clean-burning hydrogen as a fuel source. The hydrogen evolution reaction (HER) is of particular interest as a means for commercially producing hydrogen as a fuel source. The HER is a conversion reaction of protons to $H_2$ and requires reducing equivalents and, typically, a catalyst. In nature, HER is catalyzed by hydrogenase enzymes and in commercial electrolyzers, platinum is typically employed as an electrocatalyst.

In commercial electrolyzers, the HER ($2H^+ + 2e^- \rightarrow H_2$) is the cathodic reaction in electrochemical water splitting. Driving the HER with renewable sources of energy can lead to a sustainable source of hydrogen fuel that can stored, transported, and used in a zero-emission fuel cell of a combustion engine, for example. Achieving high energetic efficiency for water splitting requires the use of a catalyst to minimize the overpotential necessary to drive the HER. As noted above, platinum is presently the most common catalyst for HER and requires very small overpotentials, even at high reaction rates in acidic solutions. However, the scarcity and high cost of platinum limits its widespread technological use. Further, the extraction of platinum ore and its conversion into pure platinum is not only energy and time intensive but has severe ecological impacts as well. It would be desirable to be able to replace platinum with a sustainable and environmentally-friendly electrocatalyst.

Thus, a method of making a metal-N/S-doped carbon electrocatalyst solving the aforementioned problems is desired.

SUMMARY

The method of making a metal-N/S-doped carbon electrocatalyst is a method of making an electrocatalyst for an electrolyzing electrode or the like. The carbon for the electrocatalyst can come from goat hooves as a sustainable and environmentally friendly source of carbon. At least one goat hoof can be cleaned and then sonicated for approximately 15 minutes. The cleaned and sonicated goat hoof can then be calcined at a temperature of up to approximately 300° C. to produce a carbonaceous precursor. The calcining of the at least one goat hoof may be performed in an argon environment (approximately 300 mL/min) at a heating rate of approximately 5° C./min for approximately 3 hours.

Following calcining, the carbonaceous precursor can be treated with a HCl solution (0.5 M) as an activator, followed by drying at approximately 80° C. for approximately 6 hours. At least one metal salt can be added to the treated carbonaceous precursor, and the at least one metal salt and the treated carbonaceous precursor can be heated at approximately 800° C. for approximately 3 hours to form the metal-N/S-doped carbon electrocatalyst. The heating may be performed with a heating rate of approximately 5° C./min under a helium atmosphere in a tube furnace or the like.

The at least one metal salt may be nickel chloride to form a nickel and N/S-doped graphite carbon electrocatalyst (referred to herein as "Ni—N/S@GC") or, alternatively, the at least one metal salt may be a combination of nickel chloride and iron nitrate to form a nickel, iron and N/S-doped graphite carbon electrocatalyst (referred to herein as "NiFe—N/S@GC"). It is noted that the goat hoof is the source of the sulfur and may be at least a partial source of the nitrogen. After cooling to room temperature, the metal-N/S-doped carbon electrocatalyst may be washed several times with an aqueous HCl solution (1.0 M), deionized water and ethanol. The resultant product may then be dried at approximately 80° C. for approximately 24 hours.

In order to make an electrolyzing electrode from the metal-N/S-doped carbon electrocatalyst, the metal-N/S-doped carbon electrocatalyst is mixed in aqueous ethanol solution. The aqueous ethanol solution may have an ethanol to water ratio of 1:1 (v/v). The mixture can then be sonicated for approximately 30 minutes to produce a catalyst ink. The catalyst ink can be applied to a glassy carbon electrode substrate by dropwise casting to form an intermediate electrode. The intermediate electrode can then be dried and a solution of $C_7HF_{13}O_5S{\cdot}C_2F_4$ (i.e., Nafion®) can be applied to the dried intermediate electrode by dropwise casting. Once dried, the resultant product is an electrolyzing electrode.

These and other features of the present subject matter will become readily apparent upon further review of the following specification.

BRIEF DESCRIPTION OF DRAWINGS

The patent or application file contains at least one drawing executed in color. Copies of this patent or patent application publication with color drawing(s) will be provided by the Office upon request and payment of the necessary fee.

Similar reference characters denote corresponding features consistently throughout the attached drawings.

DETAILED DESCRIPTION

Figure 1:
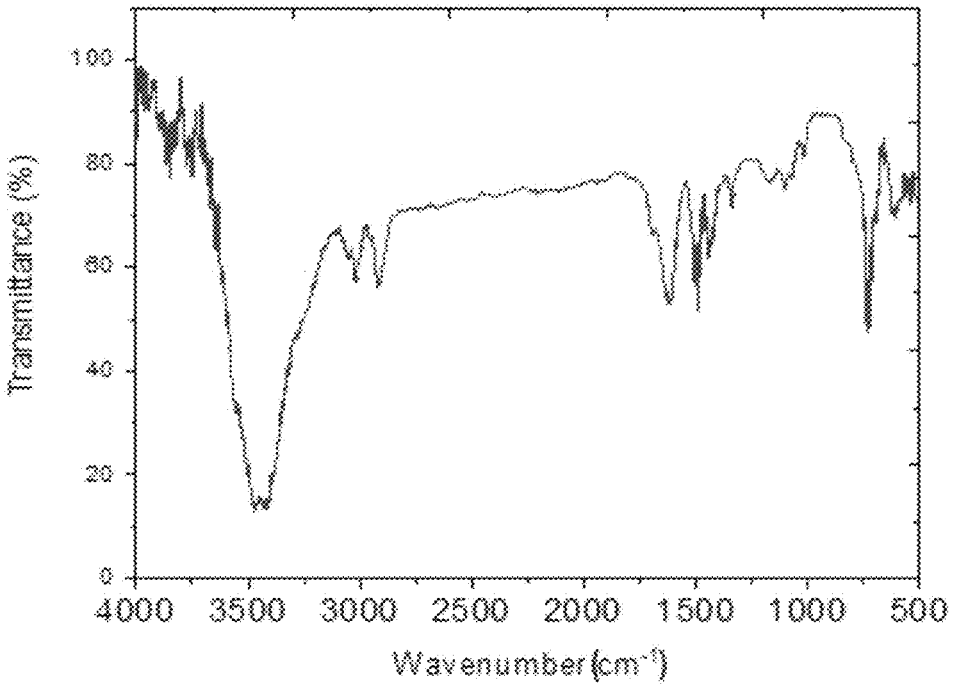
FIG. 1 is a graph showing the Fourier transform infrared (FTIR) spectra of Ni—N/S@GC and NiFe—N/S@GC electrocatalyst samples prepared using the method of making a metal-N/S-doped carbon electrocatalyst.

The method of making a metal-N/S-doped carbon electrocatalyst is a method of making an electrocatalyst for an electrolyzing electrode or the like. The carbon for the electrocatalyst can come from goat hooves as a sustainable and environmentally friendly source of carbon. At least one goat hoof can be cleaned and then sonicated for approximately 15 minutes. The cleaned and sonicated goat hoof can then be calcined at a temperature of up to approximately 300° C. to produce a carbonaceous precursor. The calcining of the at least one goat hoof may be performed in an argon environment (approximately 300 mL/min) at a heating rate of approximately 5° C./min for approximately 3 hours.

Following calcining, the carbonaceous precursor can be treated with a HCl solution (0.5 M) as an activator, followed by drying at approximately 80° C. for approximately 6 hours. At least one metal salt can be added to the treated carbonaceous precursor, and the at least one metal salt and the treated carbonaceous precursor can be heated at approximately 800° C. for approximately 3 hours to form the metal-N/S-doped carbon electrocatalyst. The heating may be performed with a heating rate of approximately 5° C./min under a helium atmosphere in a tube furnace or the like. As a non-limiting example, the at least one metal salt and the treated carbonaceous precursor may have a 1:1 weight ratio.

The at least one metal salt may be nickel chloride to form a nickel and N/S-doped graphite carbon electrocatalyst (referred to herein as "Ni—N/S@GC") or, alternatively, the at least one metal salt may be a combination of nickel chloride and iron nitrate to form a nickel, iron and N/S-doped graphite carbon electrocatalyst (referred to herein as "NiFe—N/S@GC"). It is noted that the goat hoof is the source of the sulfur and may be at least a partial source of the nitrogen. After cooling to room temperature, the metal-N/S-doped carbon electrocatalyst may be washed several times with an aqueous HCl solution (1.0 M), deionized water and ethanol. The resultant product may then be dried at approximately 80° C. for approximately 24 hours.

In order to make an electrolyzing electrode from the metal-N/S-doped carbon electrocatalyst, the metal-N/S-doped carbon electrocatalyst can be mixed in aqueous ethanol solution. The aqueous ethanol solution may have an ethanol to water ratio of 1:1 (v/v). The mixture can then be sonicated for approximately 30 minutes to produce a catalyst ink. The catalyst ink can be applied to a glassy carbon electrode substrate by dropwise casting to form an intermediate electrode. The intermediate electrode can then be dried and a solution of $C_7HF_{13}O_5S \cdot C_2F_4$ (i.e., Nafion®) can be applied to the dried intermediate electrode by dropwise casting. Once dried, the resultant product can be an electrolyzing electrode.

In experiments, sample electrodes were prepared as described above, with 10.0 mg of the metal-N/S-doped carbon electrocatalyst dispersed in 1.0 mL of the aqueous ethanol solution. 2.0 μL of the catalyst ink was dropwise cast on the glassy carbon working electrode, which was allowed to dry in air. 2.0 μL of the Nafion® solution (0.5 wt %) was drop cast on the glass carbon electrode and fully dried before testing. In the electrochemical hydrogen evolution reaction (HER) and oxygen evolution reaction (OER) experiments discussed below, all experiments were performed in 1.0 M KOH, 0.1 M $H_2SO_4$ and water media.

FIG. 1 shows the Fourier transform infrared (FTIR) spectra of Ni—N/S@GC and NiFe—N/S@GC prepared using the above method. The FTIR results show that the absorption bands at around 3286-3476 $cm^{-1}$ and 2922-3021 $cm^{1}$, corresponding to the stretching vibrations of O—H/N—H and C—H (symmetry/asymmetry), respectively. However, the C═O stretching vibration band is found at 1635 $cm^{-1}$ (corresponding to N/S-doped carbon, or "N/S@C") and another band at 1102 $cm^{-1}$ arises for the asymmetric stretching vibrations of C—NH—C, which confirms that N atoms are properly doped onto the carbon matrix. Moreover, another two bands at 1443 and 1635 $cm^{-1}$ represent the typical stretching modes of C—N and C═N, respectively. These results suggest that nitrogen atoms not only exist on the particle surface in the form of amide bonds, but also exist in the cores as polyaromatic structures. The IR bands within the range of 1000-1340 $cm^{-1}$ are attributed to the stretching vibrations of C—O, C—S, C—N and C—C, respectively. The IR bands within the range of 400-490 $cm^{-1}$ are attributed to the stretching vibrations of Ni—N and Fe—N, respectively.

Figure 2:
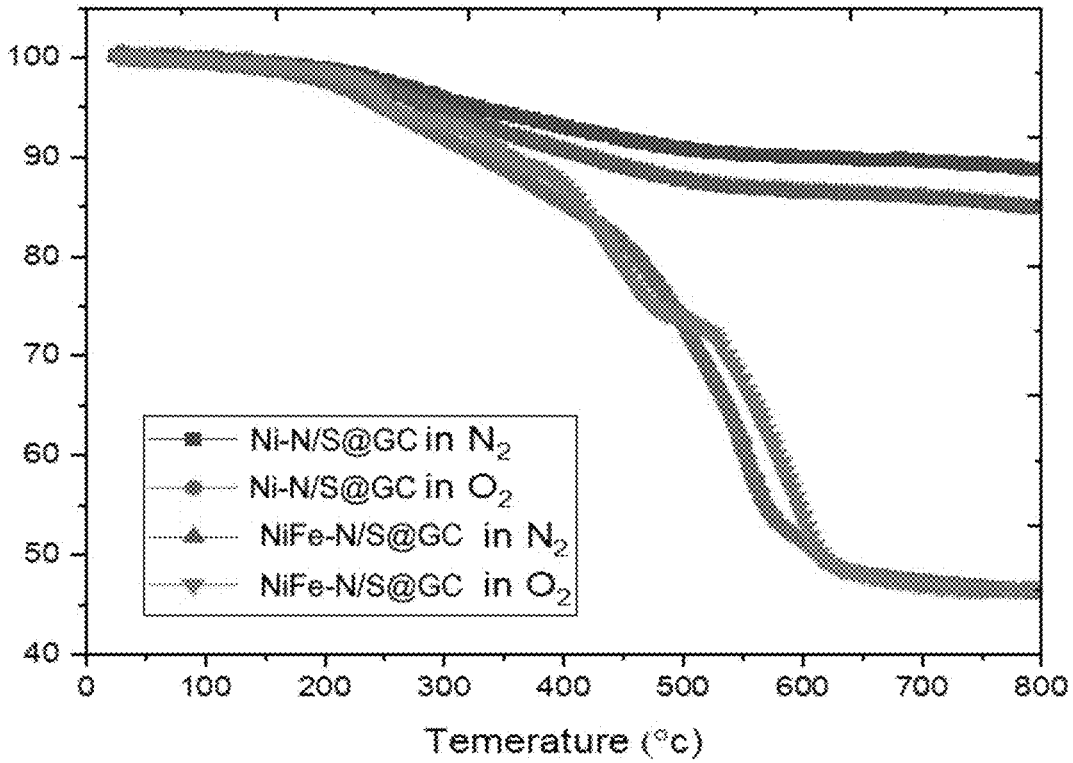
FIG. 2 is a graph showing thermogravimetric analysis (TGA) curves for the Ni—N/S@GC and NiFe—N/S@GC electrocatalyst samples prepared using the method of making a metal-N/S-doped carbon electrocatalyst.

FIG. 2 shows the thermogravimetric analysis (TGA) curves for Ni—N/S@GC and NiFe—N/S@GC prepared using the above method, both in $N_2$ and $O_2$. The results show that the prepared carbon decomposed in three stages. The first stage occurred within the temperature range 90-200° C. A 6.086% weight loss was observed in this stage, corresponding to the loss of $H_2O$ (coordinated or adsorbed). The second stage has an estimated mass loss of 57.39% within the temperature range 200-500° C. and corresponds to the loss of an organic part of the hoof-based N/S-doped graphite carbon materials. The third stage has an estimated mass loss of 17.38% within the temperature range 500-800° C., corresponding to the loss of the more stable organic part of the hoof-based N/S-doped carbon materials and leaving metal-N/S@C as a residue.

Figure 3A:
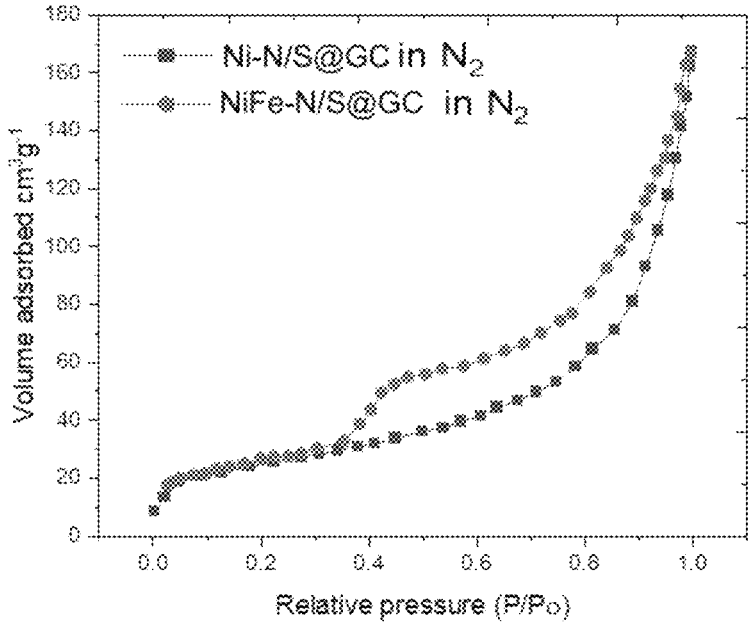
FIG. 3A is a plot showing $N_2$ adsorption results for the Ni—N/S@GC and NiFe—N/S@GC electrocatalyst samples prepared using the method of making a metal-N/S-doped carbon electrocatalyst.
Figure 3B:
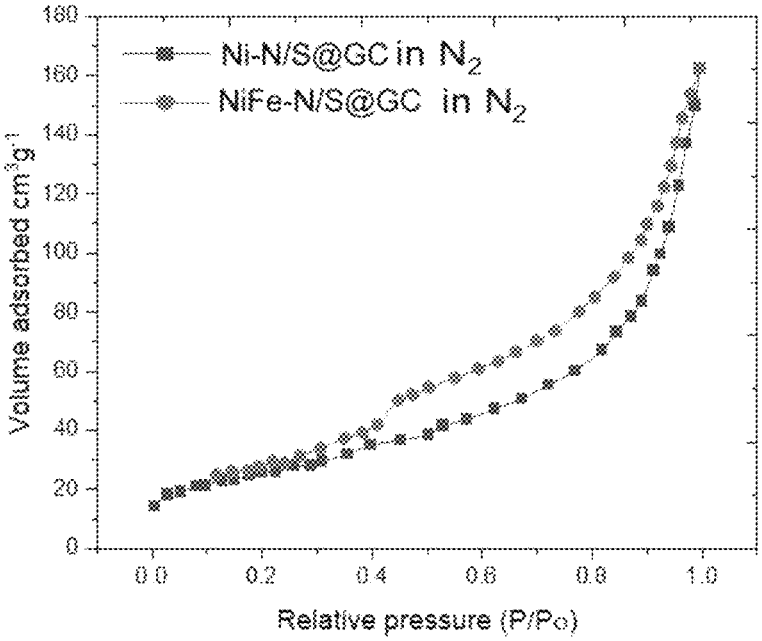
FIG. 3B is a plot showing $N_2$ desorption results for the Ni—N/S@GC and NiFe—N/S@GC electrocatalyst samples prepared using the method of making a metal-N/S-doped carbon electrocatalyst.

FIGS. 3A and 3B show $N_2$ adsorption and desorption measurements, respectively, to measure the porosity and surface nature of the metal-N/S@GC. The adsorption isotherms of FIG. 3A are type IV in the case of both types of nanoparticles and support the nonporous nature. The Brunauer-Emmett-Teller (BET) surface area of the natural adsorbent was found to be 178.4 $m^2/g$ and 189.32 $m^2/g$ for Ni—N/S@GC and NiFe—N/S@GC, respectively. It is noted that high surface area is associated with a high surface density of active sites, while the mesoporous structure ensures efficient electrolyte ions transfer.

Figure 4A:
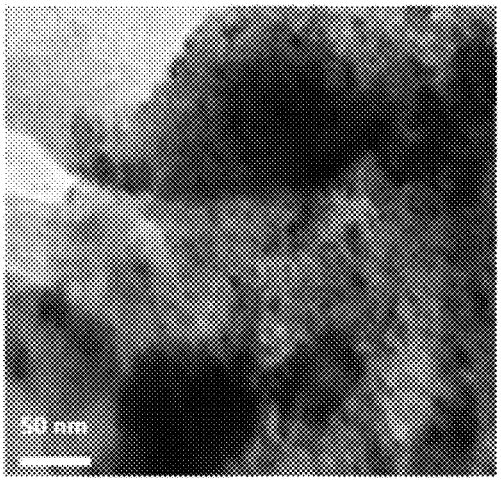
FIG. 4A shows a transmission electron microscope (TEM) image of an Ni—N/S@GC electrocatalyst sample prepared using the method of making a metal-N/S-doped carbon electrocatalyst.
Figure 4B:
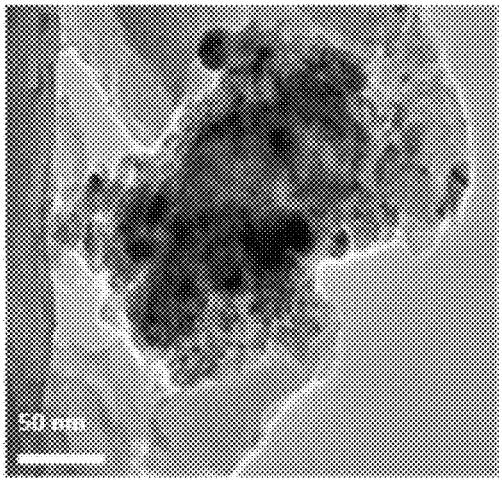
FIG. 4B shows a transmission electron microscope (TEM) image of a NiFe—N/S@GC electrocatalyst sample prepared using the method of making a metal-N/S-doped carbon electrocatalyst.

FIGS. 4A and 4B show transmission electron microscopes (TEM) images of Ni—N/S@GC and NiFe—N/S@GC, respectively, and show that the particles developed in the carbon matrix with an irregular particles size of about 15-20 nm. These images show the presence of carbon species with distinguishable size distributions of the Ni species (determined by their diameters), with the average diameter being found to be ~20 nm. Similarly, the average size of Ni—Fe bimetallic-nanoparticles was determined to be 15-20 nm.

Figure 5:
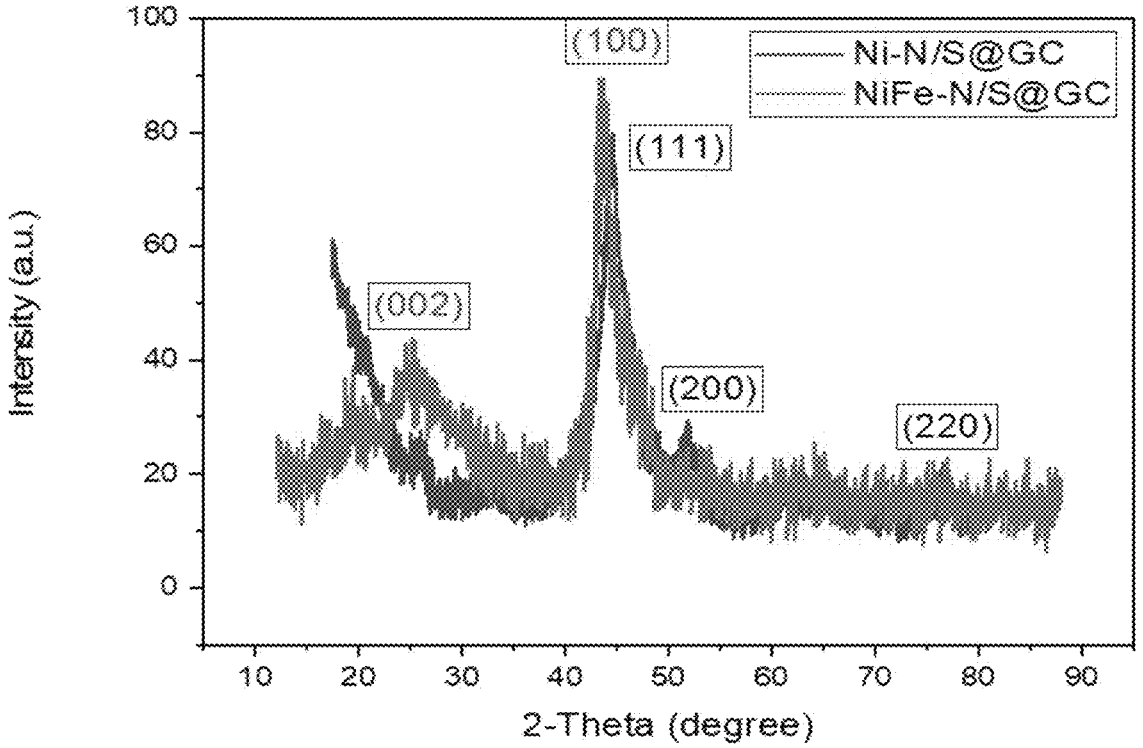
FIG. 5 is a graph showing the x-ray diffraction (XRD) spectra of the Ni—N/S@GC and NiFe—N/S@GC electrocatalyst samples prepared using the method of making a metal-N/S-doped carbon electrocatalyst.

FIG. 5 shows the x-ray diffraction (XRD) spectra of the Ni—N/S@GC and NiFe—N/S@GC electrocatalyst samples. As shown, there are diffraction peaks at 2θ values of 25.2° and 43.9°, corresponding to the (002) and (100) planes of graphite, respectively. The broad XRD reflexes refer to the disordered stacking of the graphene matrix. Moreover, a small shift in the (002) reflection to a lower angle has occurred due to the increased interlayer spacing caused by doping. There are also three major peaks observed at 2θ values of 440 and 52°, which correspond to the metallic Ni and match exactly with the JCPDS file (No. 44-6758). The corresponding planes are indexed as (111), (200) and (220). Ni—N/S@GC and NiFe—N/S@GC show well-defined XRD patterns which can be indexed to the FCC structure of Ni. However, no peaks corresponding to Fe were observed in the XRD pattern of NiFe—N/S@GC, indicating the substitution of Fe with Ni having the FCC structure.

Figure 6:
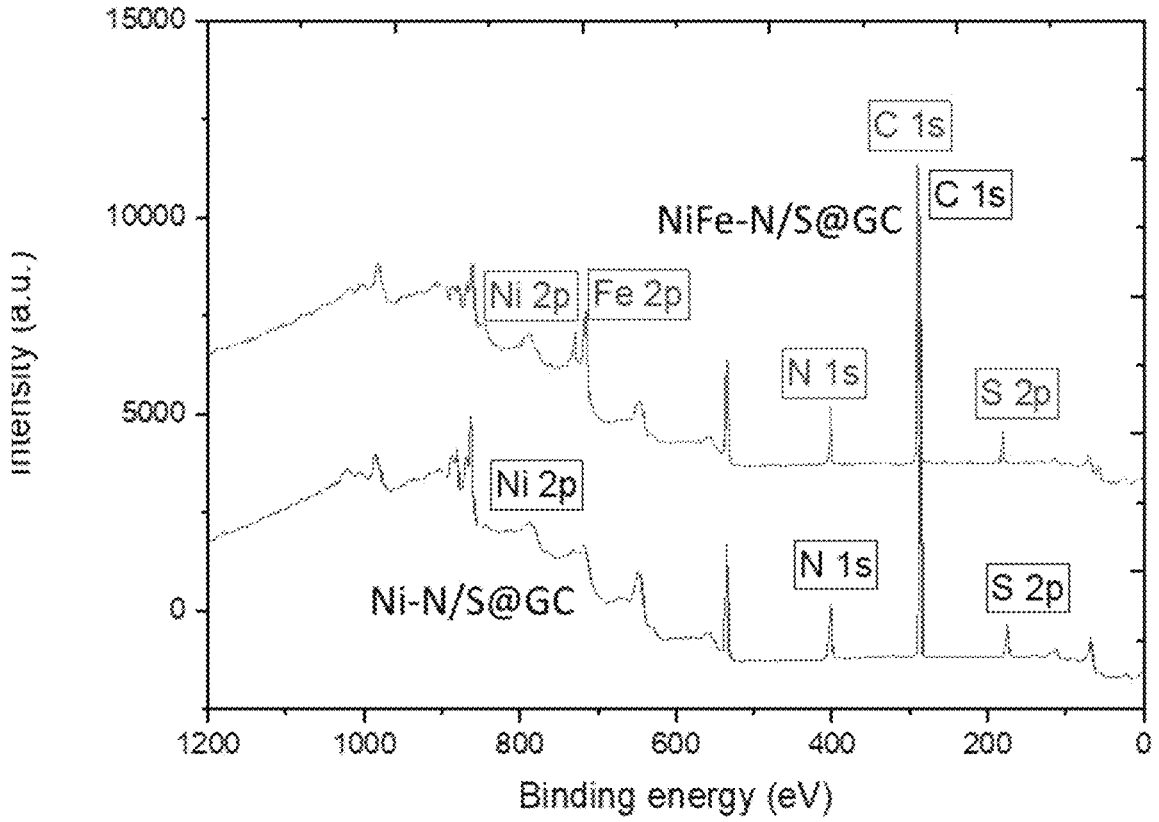
FIG. 6 is a graph showing x-ray photoelectron spectroscopy (XPS) results of the Ni—N/S@GC and NiFe—N/S@GC electrocatalyst samples prepared using the method of making a metal-N/S-doped carbon electrocatalyst.

FIG. 6 shows the x-ray photoelectron spectroscopy (XPS) results of the Ni—N/S@GC and NiFe—N/S@GC electrocatalyst samples. FIG. 6 shows that the Ni—N/S@GC mainly consists of Ni, N, S, O and C elements, while the NiFe—N/S@GC mainly consists of Ni, Fe, N, S, O and C elements.

Figure 7A:
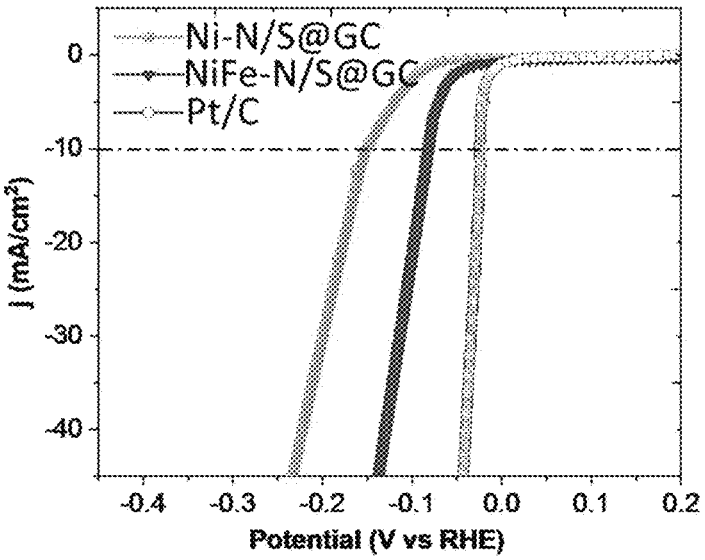
FIG. 7A is a plot showing polarization curves for the Ni—N/S@GC and NiFe—N/S@GC electrocatalyst samples at a scan rate of 10 $mV \cdot s^{-1}$ with potential error (iR) correction in 0.5 M $H_2SO_4$.
Figure 7B:
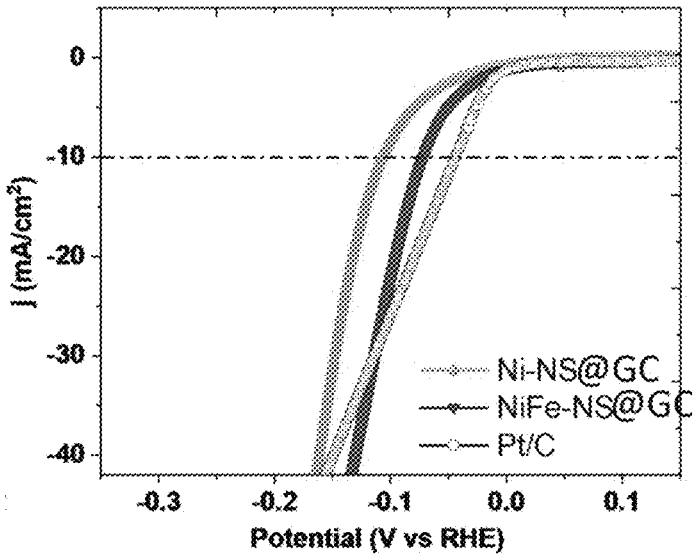
FIG. 7B is a plot showing polarization curves for the Ni—N/S@GC and NiFe—N/S@GC electrocatalyst samples at a scan rate of 10 $mV \cdot s^{-1}$ with potential error (iR) correction in 1.0 M KOH.
Figure 7C:
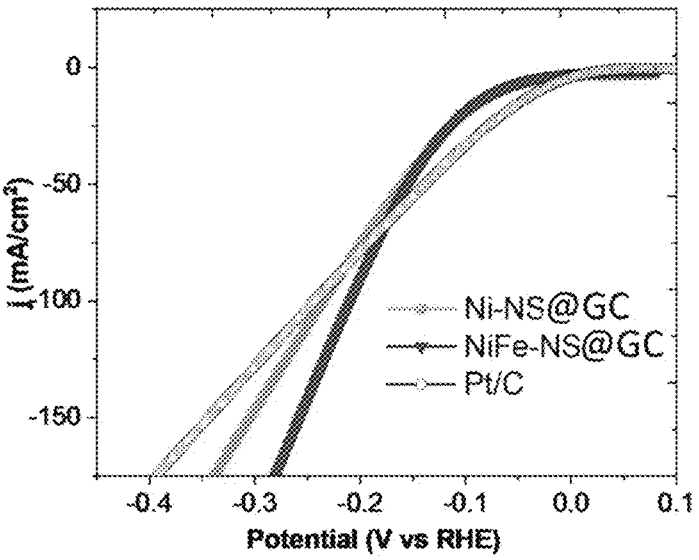
FIG. 7C is a plot showing polarization curves for the Ni—N/S@GC and NiFe—N/S@GC electrocatalyst samples at a scan rate of 10 $mV \cdot s^{-1}$ with potential error (iR) correction in a neutral aqueous solution.

FIGS. 7A, 7B and 7C are plots of the electrocatalytic performance of the Ni—N/S@GC and NiFe—N/S@GC electrocatalysts, where the performance of these catalysts for HER was investigated using a typical three-electrode system in 0.5 M $H_2SO_4$, 1 M KOH and a neutral solution. The linear sweep voltammograms of FIGS. 7A, 7B and 7C illustrate that the NiFe—N/S@GC exhibits excellent performance in HER: an overpotential of 83.2 mV and 71 mV vs. reversible hydrogen electrode (RHE) at 10 $mA \cdot cm^{-2}$, which is much lower than those of other Ni—N/S@GCs. The overpotential of NiFe—N/S@GC slightly increases to 130 mV when the current density is up to 40 $mA \cdot cm^{-2}$, which is significantly lower than that of commercial 20 wt % Pt/C (154 mV). Linear sweep voltammetry (LSV) curves for HER were assessed between −2.00 and 0.00 V (vs. Ag/AgCl) with a sweep rate of 25, 50 and 100 $mV \cdot s^{-1}$. Cyclic voltammetry (CV) curves at various scan rates (20, 40, 60, 80 and 100 $mV \cdot s^{-1}$) were carried out in the potential range of −0.10 to 0.10 V, where no faradaic current was produced.

Figure 8A:
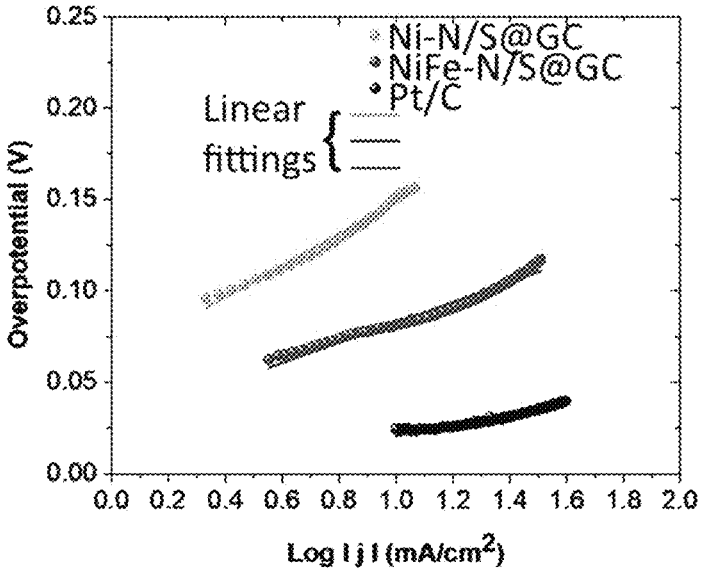
FIG. 8A is a Tafel plot showing the electrocatalytic HER mechanisms for the Ni—N/S@GC and NiFe—N/S@GC electrocatalyst samples in 0.5 M $H_2SO_4$.
Figure 8B:
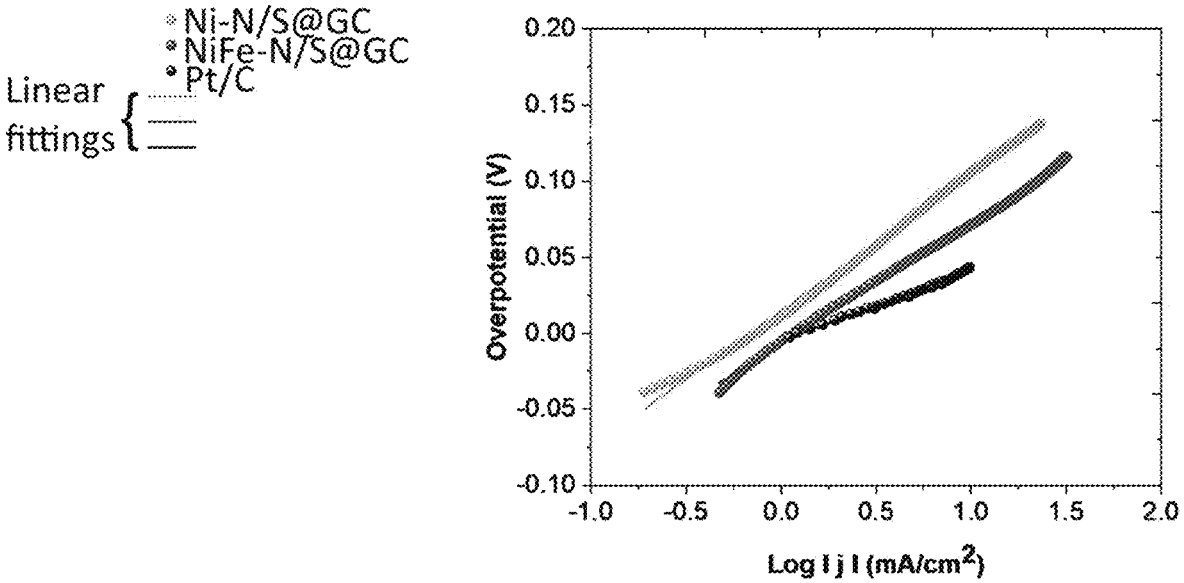
FIG. 8B is a Tafel plot showing the electrocatalytic HER mechanisms for the Ni—N/S@GC and NiFe—N/S@GC electrocatalyst samples in 1.0 M KOH.
Figure 8C:
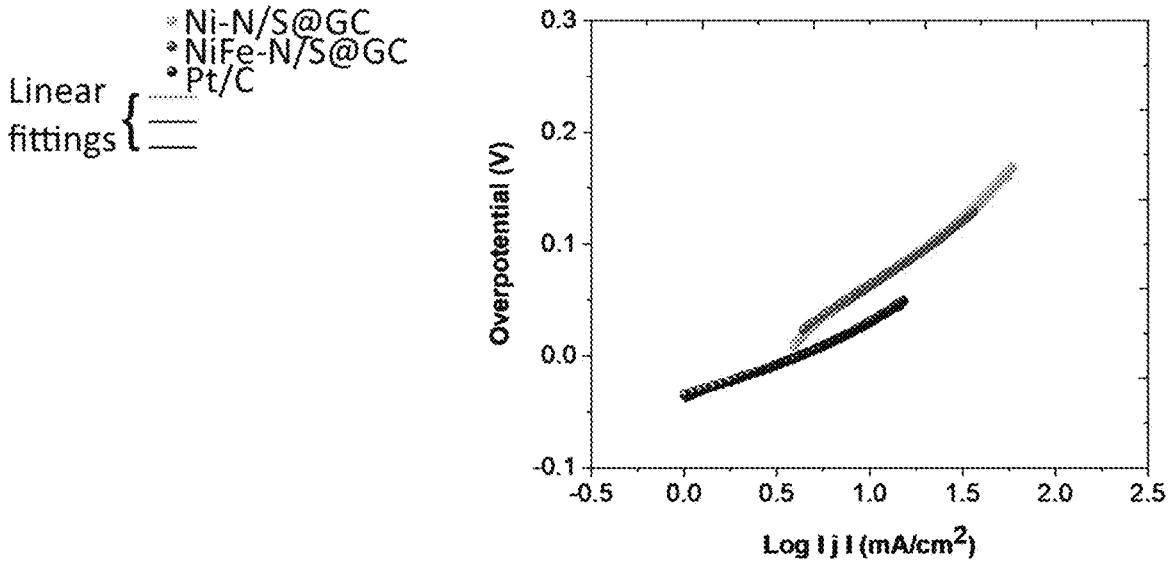
FIG. 8C is a Tafel plot showing the electrocatalytic HER mechanisms for the Ni—N/S@GC and NiFe—N/S@GC electrocatalyst samples in a neutral aqueous solution.

The electrocatalytic HER mechanisms of the NiFe—N/S@GC were examined by constructing Tafel plots, as shown in FIGS. 8A, 8B and 8C, where it can be seen that the plots have a smaller slope (42 $mV \cdot dec^{-1}$) than those of bulk Ni—N/S@GC (86.2 $mV \cdot dec^{-1}$) in an acidic medium. This indicates that a fast Heyrovsky step dominates the Volmer-Heyrovsky process during NiFe—N/S@GC $H_2$ evolution, which is attributable to the strong electronic coupling within the metal ions dispersed atoms and heterostructure N/S-doped carbon.

It is to be understood that the method of making a metal-N/S-doped carbon electrocatalyst is not limited to the specific embodiments described above, but encompasses any and all embodiments within the scope of the generic language of the following claims enabled by the embodiments described herein, or otherwise shown in the drawings or described above in terms sufficient to enable one of ordinary skill in the art to make and use the claimed subject matter.

The invention claimed is:

1. A method of making a metal-N/S-doped carbon electrocatalyst, comprising:

cleaning at least one goat hoof;

sonicating the at least one goat hoof;

calcining the at least one goat hoof at a temperature of 300° C. to produce a carbonaceous precursor;

treating the carbonaceous precursor with a HCl solution;

drying the treated carbonaceous precursor;

adding at least one metal salt to the treated carbonaceous precursor; and heating the at least one metal salt and the treated carbonaceous precursor to form a metal-N/S-doped carbon electrocatalyst.

2. The method of making a metal-N/S-doped carbon electrocatalyst as recited in claim 1, wherein the step of sonicating the at least one goat hoof is performed for 15 minutes.

3. The method of making a metal-N/S-doped carbon electrocatalyst as recited in claim 1, wherein the step of calcining the at least one goat hoof is performed in an argon environment at a heating rate of 5° C./min for 3 hours.

4. The method of making a metal-N/S-doped carbon electrocatalyst as recited in claim 1, wherein the step of drying the treated carbonaceous precursor comprises drying the treated carbonaceous precursor at 80° C. for 6 hours.

5. The method of making a metal-N/S-doped carbon electrocatalyst as recited in claim 1, wherein the at least one metal salt comprises nickel chloride.

6. The method of making a metal-N/S-doped carbon electrocatalyst as recited in claim 1, wherein the at least one metal salt comprises nickel chloride and iron nitrate.

7. The method of making a metal-N/S-doped carbon electrocatalyst as recited in claim 1, wherein the step of heating the at least one metal salt and the treated carbonaceous precursor is performed at 800° C. for 3 hours.

8. The method of making a metal-N/S-doped carbon electrocatalyst as recited in claim 7, wherein the step of heating the at least one metal salt and the treated carbonaceous precursor is performed with a heating rate of 5° C./min under a helium atmosphere.

9. The method of making a metal-N/S-doped carbon electrocatalyst as recited in claim 1, further comprising the step of washing the metal-N/S-doped carbon electrocatalyst with an aqueous HCl solution, deionized water and ethanol.

10. The method of making a metal-N/S-doped carbon electrocatalyst as recited in claim 9, further comprising the step of drying the washed metal-N/S-doped carbon electrocatalyst at 80° C. for 24 hours.

11. A method of making an electrolyzing electrode, comprising the steps of:

mixing the metal-N/S-doped carbon electrocatalyst made according to claim 1 in aqueous ethanol solution;

sonicating the metal-N/S-doped carbon electrocatalyst and the aqueous ethanol solution to produce a catalyst ink;

dropwise casting the catalyst ink on a glassy carbon electrode substrate to form an intermediate electrode;

drying the intermediate electrode; and dropwise casting a solution of $C_7HF_{13}O_5S{\cdot}C_2F_4$ on the dried intermediate electrode to form an electrolyzing electrode.

12. The method of making an electrode as recited in claim 11, wherein the aqueous ethanol solution has an ethanol to water ratio of 1:1 (v/v).

13. The method of making an electrode as recited in claim 11, wherein the step of sonicating the metal-N/S-doped carbon electrocatalyst and the aqueous ethanol solution is performed for 30 minutes.

* * * * *